US006502355B1

(12) United States Patent
Bori

(10) Patent No.: US 6,502,355 B1
(45) Date of Patent: Jan. 7, 2003

(54) STORM COVER FOR PROTECTING EXTERIOR BUILDING GLASS AND ASSOCIATED METHOD

(76) Inventor: Albert Bori, 9149 Laws Rd., Clermont, FL (US) 34711

( * ) Notice: Subject to any disclaimer, the term of this patent is extended or adjusted under 35 U.S.C. 154(b) by 0 days.

(21) Appl. No.: 09/435,758

(22) Filed: Nov. 8, 1999

(51) Int. Cl.[7] ..... E06B 3/26

(52) U.S. Cl. ..... 52/202; 52/203; 52/171.3; 428/34; 269/97; 248/110; 248/201; 248/205.5; 248/206.3; 248/206.4; 248/309.1; 248/363; 49/50; 49/57; 49/61; 49/62; 49/463; 49/465

(58) Field of Search ..... 52/202, 203, 171.3; 428/34; 269/97; 49/50, 57, 61, 62, 463, 465; 248/110, 206.4, 205.5, 309.1, 206.3, 201, 363

(56) References Cited

U.S. PATENT DOCUMENTS

| | | | | | |
|---|---|---|---|---|---|
| 1,119,177 | A | | 12/1914 | Krafft | |
| 1,630,208 | A | | 5/1927 | Norbeck | |
| 1,635,906 | A | | 7/1927 | Reed | |
| 1,636,879 | A | | 7/1927 | Tichota | |
| 1,679,802 | A | | 8/1928 | Allerheiligen et al. | |
| 1,681,443 | A | | 8/1928 | Steinman | |
| 1,694,676 | A | | 12/1928 | Will | |
| RE17,821 | E | | 10/1930 | Steinman | |
| 1,799,445 | A | | 4/1931 | Stansberry | |
| 2,385,977 | A | | 10/1945 | Farmer | |
| 2,558,817 | A | | 7/1951 | Bryant | |
| 2,607,088 | A | | 8/1952 | Schoepfer | |
| 2,910,264 | A | | 10/1959 | Lindenberger | |
| 3,531,155 | A | * | 9/1970 | Wilbanks | 296/95 |
| 3,635,332 | A | | 1/1972 | Ross | 206/46 |
| 3,649,069 | A | * | 3/1972 | Zip | 296/97 |
| 4,196,882 | A | | 4/1980 | Rognon | 248/206 |
| 4,309,956 | A | | 1/1982 | Yamaguchi | |
| 4,406,246 | A | | 9/1983 | DeMeyer et al. | |
| 4,544,587 | A | * | 10/1985 | Nesbitt | 428/34 |
| 4,943,018 | A | | 7/1990 | Glaser et al. | 248/110 |
| 5,102,146 | A | * | 4/1992 | Kurland | 273/412 |
| 5,314,226 | A | | 5/1994 | Tovar | |
| 5,722,206 | A | * | 3/1998 | McDonald | 52/202 |
| 5,918,430 | A | | 7/1999 | Rowland | 52/202 |
| 6,155,009 | A | * | 12/2000 | Pena | 52/202 |
| 6,244,778 | B1 | * | 6/2001 | Chesbrough | 403/51 |

* cited by examiner

*Primary Examiner*—Yvonne M. Horton
*Assistant Examiner*—Christy Green
(74) *Attorney, Agent, or Firm*—Allen, Dyer, Doppelt, Milbrath & Gilchrist, P.A.

(57) ABSTRACT

A storm cover for protecting a building's exterior glass includes a resiliently rigid protective storm panel connected directly to the glass so as to substantially cover the glass surface. The protective storm panel is connected to the glass by shock absorbing connectors positioned to hold the panel on the glass and spaced apart therefrom, to substantially protect the glass from impact by distributing the force of an impact. The protective storm panel is made of a substantially resiliently rigid material such as wood, plastic, or light gauge metal, and the exterior glass is preferably a glass window or glass door. The protective storm panel may be sized so as to overlap a frame surrounding the window or door to thereby provide added protection.

19 Claims, 12 Drawing Sheets

STORM COVER FOR PROTECTING EXTERIOR BUILDING GLASS AND ASSOCIATED METHOD

FIELD OF THE INVENTION

The present invention relates to the field of storm covers and, more particularly, to storm covers mounted directly onto an exterior glass surface such as a glass window or glass door for protecting the glass from impact by wind driven objects.

BACKGROUND OF THE INVENTION

Severe storms such as hurricanes cause significant economic damage in the United States every year. The high winds which accompany such storms are known to pick up loose objects and turn them into wind driven projectiles. Wind driven objects and other debris account for much of the damage related to broken exterior glass in buildings in the storm's path. Property owners commonly board up their glass windows and doors with plywood as protection against wind driven flying debris. More sophisticated protection for glass windows and doors includes removable or permanently installed metal shutters. Metal shutters are available as fold-down awnings, accordion type shutters which roll across windows or doors, roll-down flexible metal screens, and removable panels which may be put up before the storm and taken down afterwards for storage.

All these systems have their own advantages and disadvantages. Metal shutters, of course, are expensive and require professional, custom installation. Metal shutters may require appropriate periodic maintenance to ensure smooth functioning and adequate closing. Plywood is less expensive than metal shutters, however, it is well known that a storm-panicked public will exhaust local supplies of plywood in the final days before arrival of the storm. Long lines of anxious and often angry people tend to form at local lumber supply houses while the storm approaches. When available, plywood shutters may be configured for repeated use by being provided with appropriately spaced holes so that they may be screwed into window frames, door frames and the like. Such preparation is time-consuming, requires at least some minimal expertise and tools, and requires that some damage be done to the building by drilling or nailing into the window and door frames.

SUMMARY OF THE INVENTION

With the foregoing in mind, the present invention advantageously provides a storm cover for substantially protecting exterior glass from impact by wind driven objects. The storm cover is effective, inexpensive, reusable, and requires little expertise for positioning on glass windows and glass doors. The storm cover may be positioned quickly, and without causing damage to the frame surrounding the glass window or door. In addition, glass windows and doors of any size and shape may be protected against impact by use of the appropriately sized present storm cover.

The storm cover includes a substantially resiliently rigid protective storm panel for positioning over the glass, and a shock absorbing connector for connecting the protective panel to the glass so as to hold the panel in position for protecting the glass window or door. The protective storm panel is preferably positioned so as to cover the glass, and is spaced apart therefrom. Unlike previously known storm covers, the storm cover of the present invention is directly connected to the glass and does not require connection to the frame of the window or door. The resiliently rigid protective storm panel preferably comprises a wood or wood product material, such as plywood. The panel may also be made of a resilient, yet rigid plastic such as Plexiglas®, Lucite®, or Lexan® to thereby allow viewing through the glass door or window.

The present invention advantageously also includes a connector for connecting the resiliently rigid protective storm panel to glass in a door or window. The connector includes a shock absorbing connector member for connecting to the glass, and a fastener positioned on the connector member for fastening the connector to the storm cover.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF A PREFERRED EMBODIMENT

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime notation when used indicates similar elements in alternative embodiments.

Figure 1:
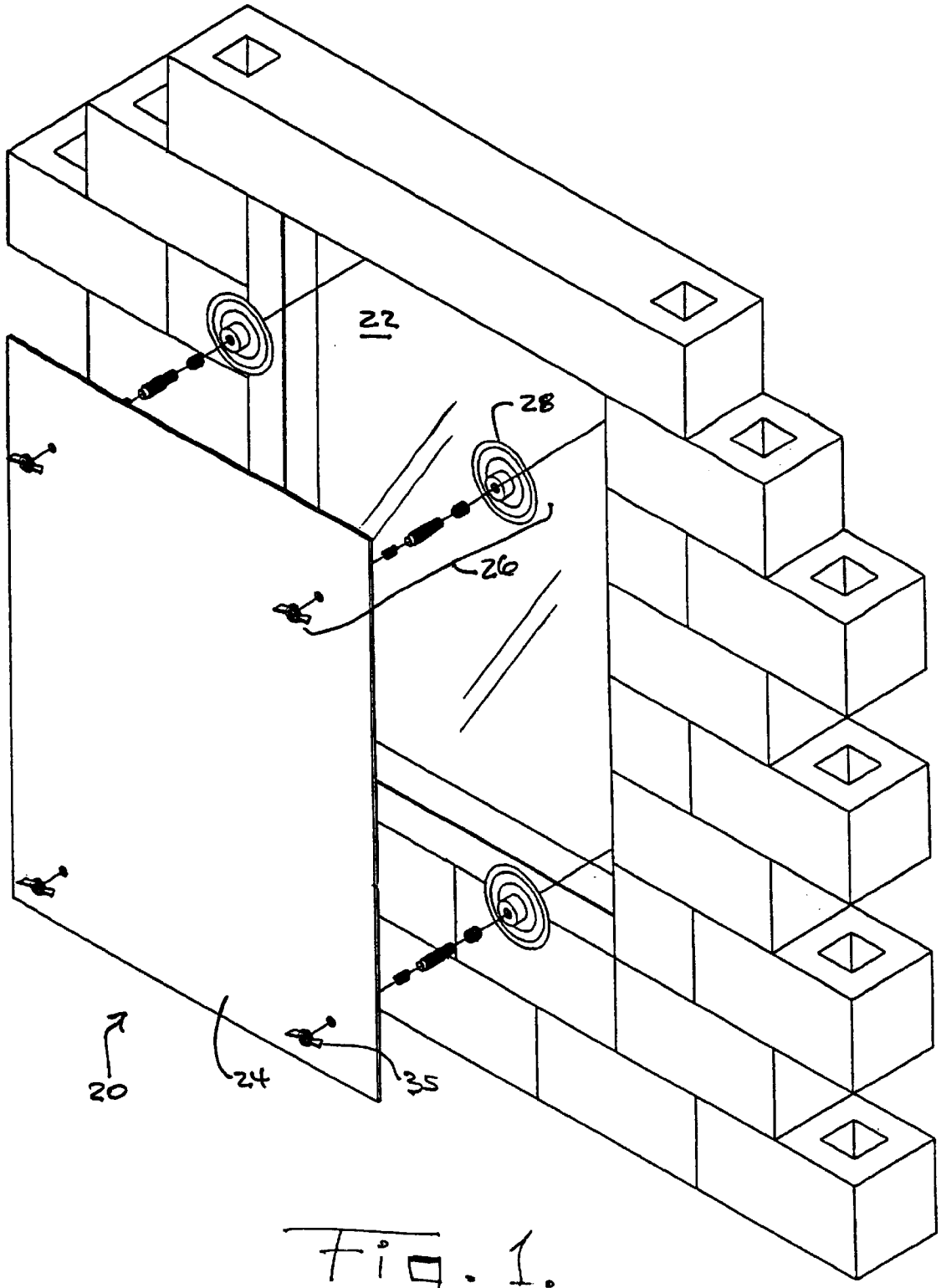
FIG. 1 is an exploded view of the storm cover as placed over a window according to an embodiment of the present invention.
Figure 8:
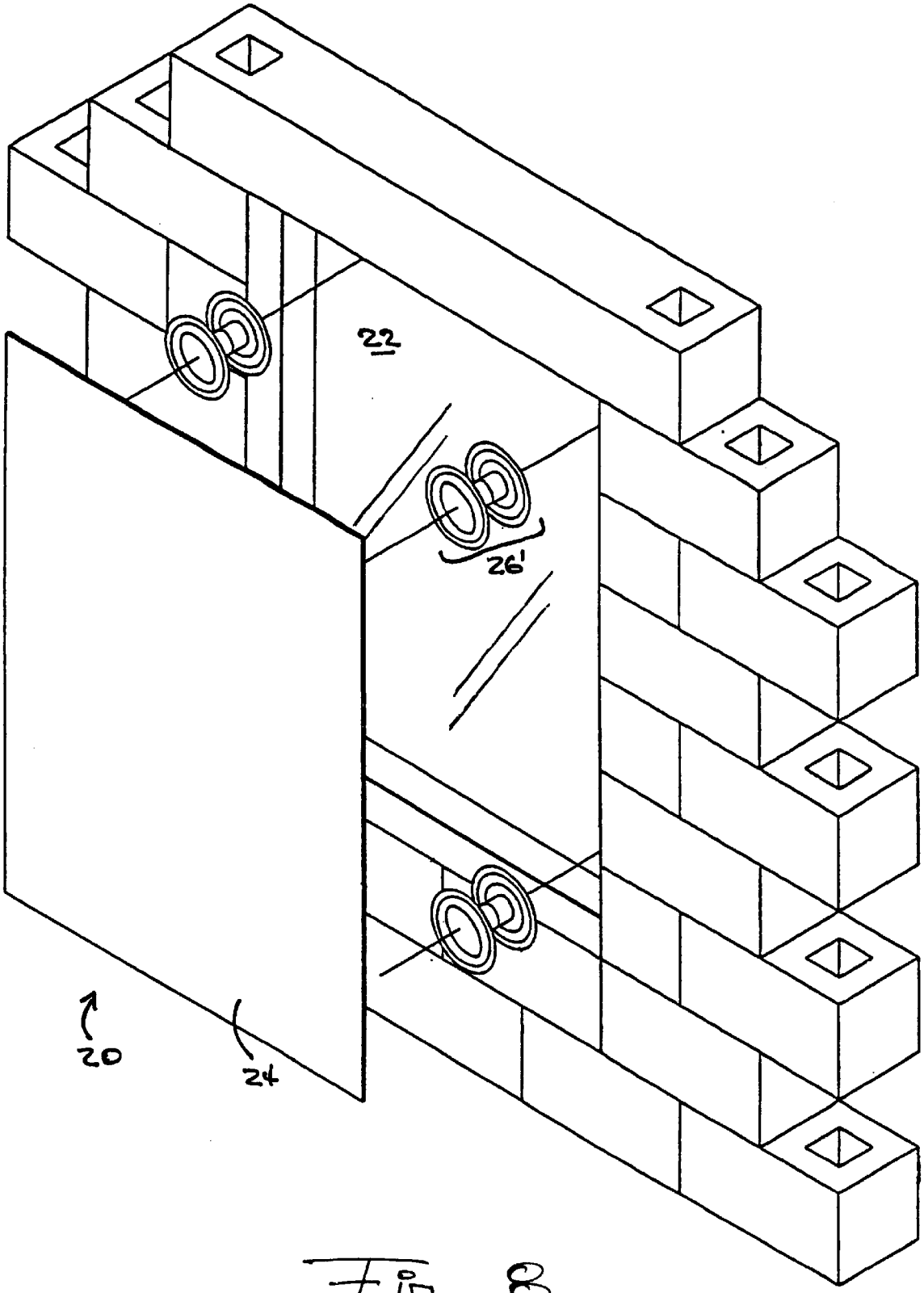
FIG. 8 is an exploded view of the storm cover having double-ended suction cup connectors.

The present invention discloses a storm cover 20 for protecting exterior glass, and is particularly useful for substantially protecting glass doors and windows from impact by wind driven objects during a storm such as a hurricane. As shown in FIGS. 1 and 8, a particularly advantageous feature of the invention is the ability to connect the storm cover 20 directly to glass 22, such as in a window or glass door. This feature makes the storm cover 20 very easy to use; reducing the requirement for tools and eliminating the need for drilling or nailing into window frames and the like. In one preferred embodiment, drilling is required for positioning holes through which to fasten the connectors to the protective storm panel, as shown in FIG. 1. Once prepared in such a manner, the storm cover 20 may be very quickly put in position over windows and doors without further need for tools, thus shortening the homeowner's preparation time before a storm.

As shown in FIGS. 1–9, the storm cover 20 includes a resiliently rigid protective storm panel 24 for positioning over the glass 22, and so as to substantially cover the glass when the protective storm panel is properly sized and positioned. The term "resiliently rigid" is intended to indicate a substantially rigid material such as a sheet of plywood, hard plastic, or light gauge metal, which however also provides relative resilience so that it is able to bend within limits to thereby help absorb the shock of an impact. A shock absorbing connector 26 is positioned on the protective storm panel 24 for connecting the panel directly to the glass 22. The shock absorbing connector 26 preferably holds the protective panel 24 in position over and spaced apart from the glass 22, thereby substantially protecting the glass. In addition, the connectors 26 provide the advantage of removably connecting the protective storm panel 24 to the glass 22, as seen in FIGS. 1 and 7–9.

Figure 2:
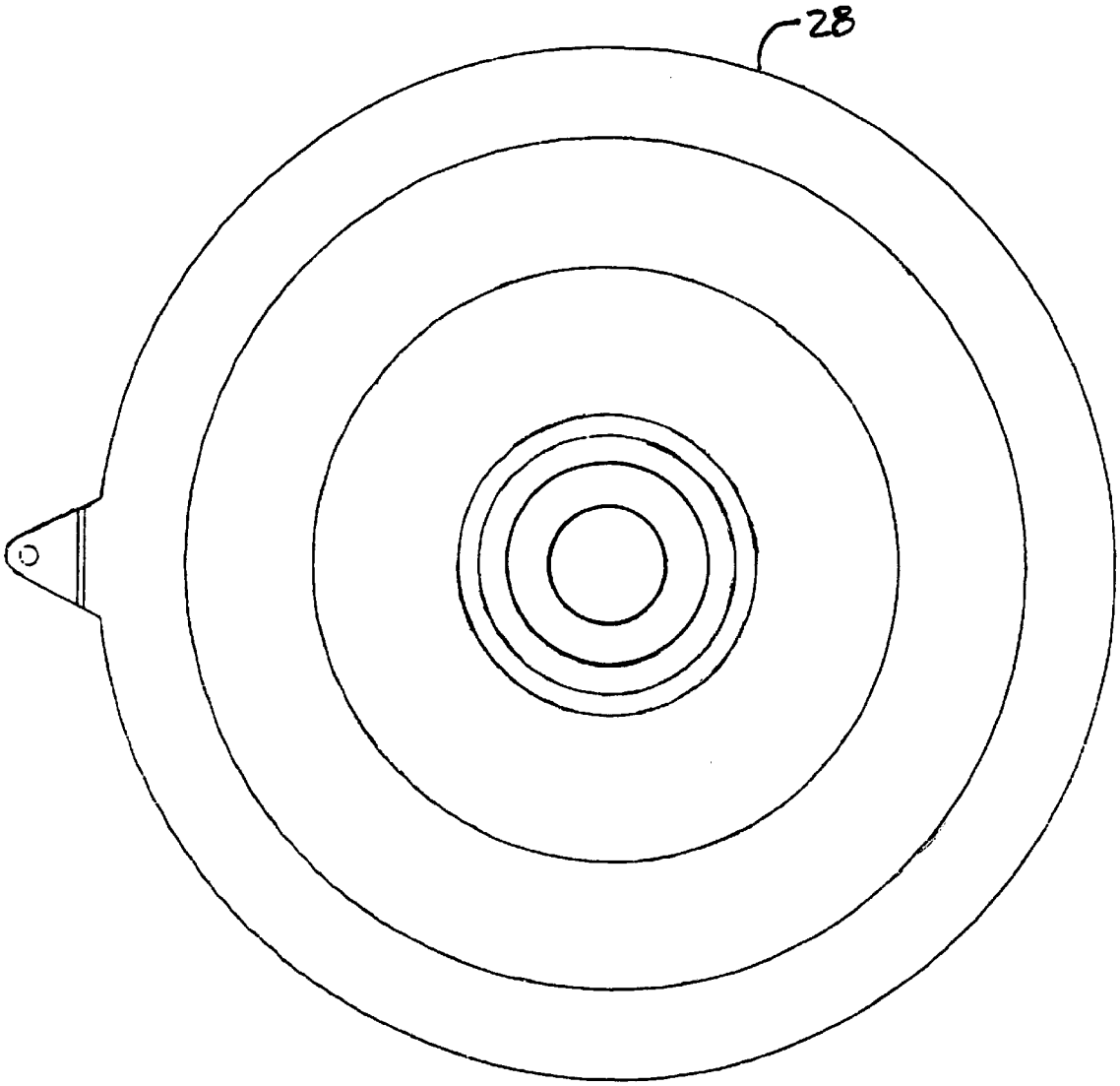
FIG. 2 is a bottom plan view of a suction cup used on the storm cover shown in FIG. 1.
Figure 3:
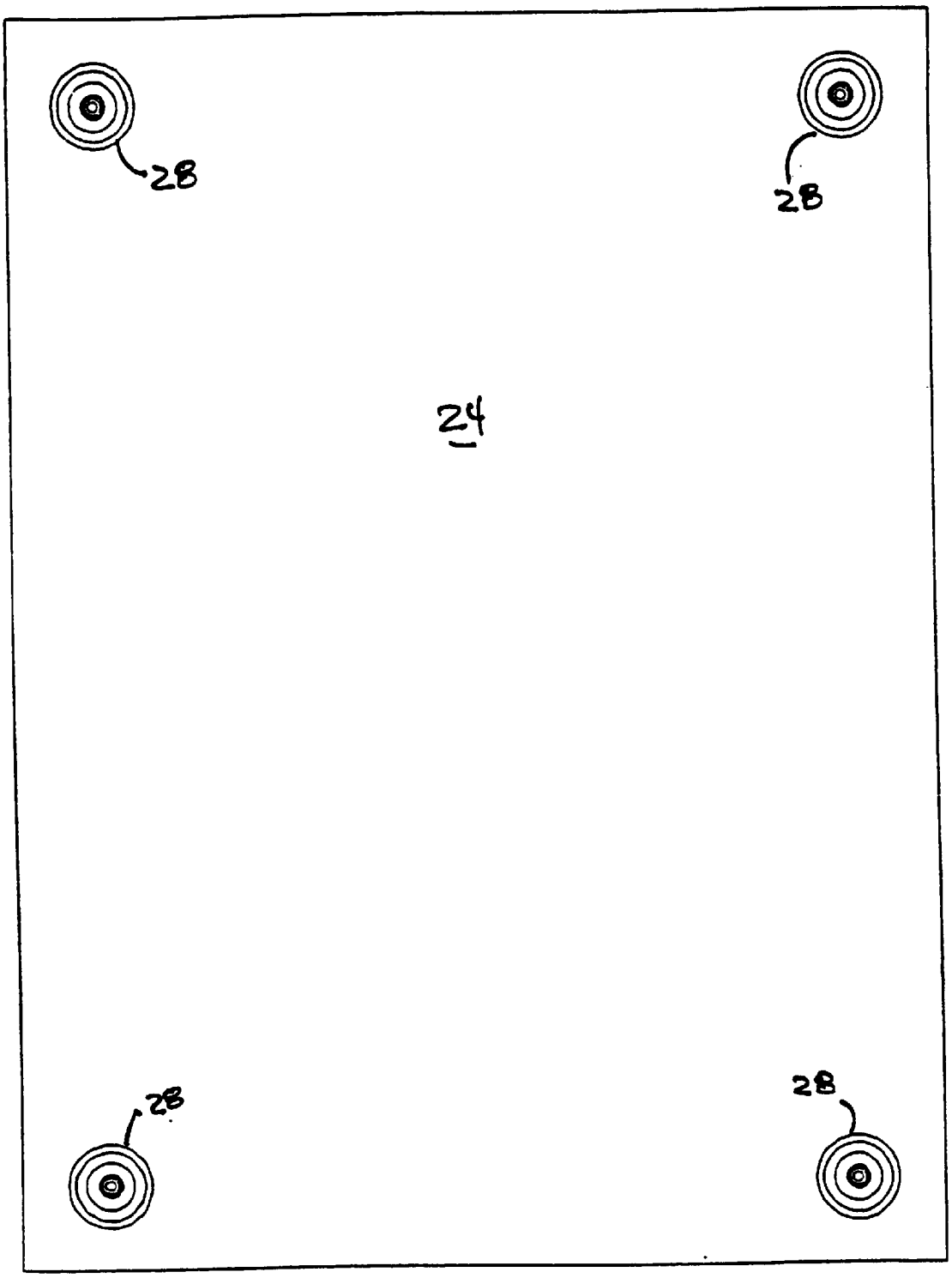
FIG. 3 is an elevation back view of the storm cover.
Figure 4A:
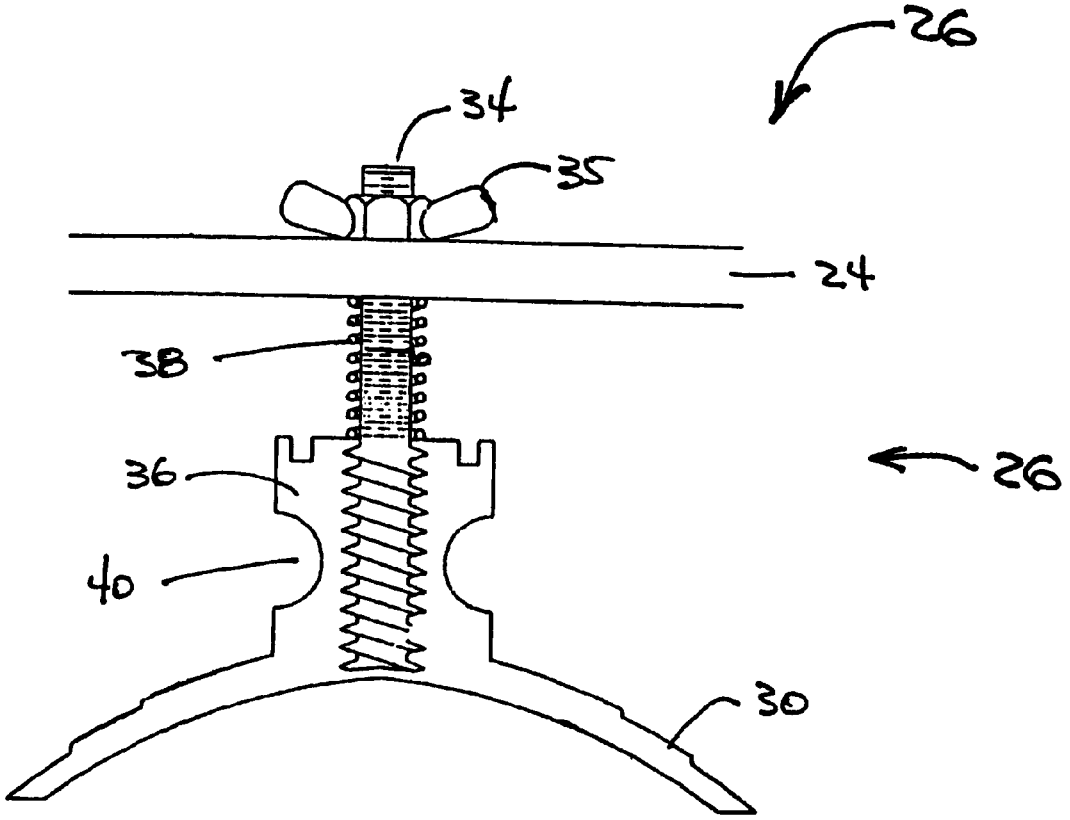
FIG. 4 is a cross-sectional view of a shock absorbing connector.
Figure 4B:
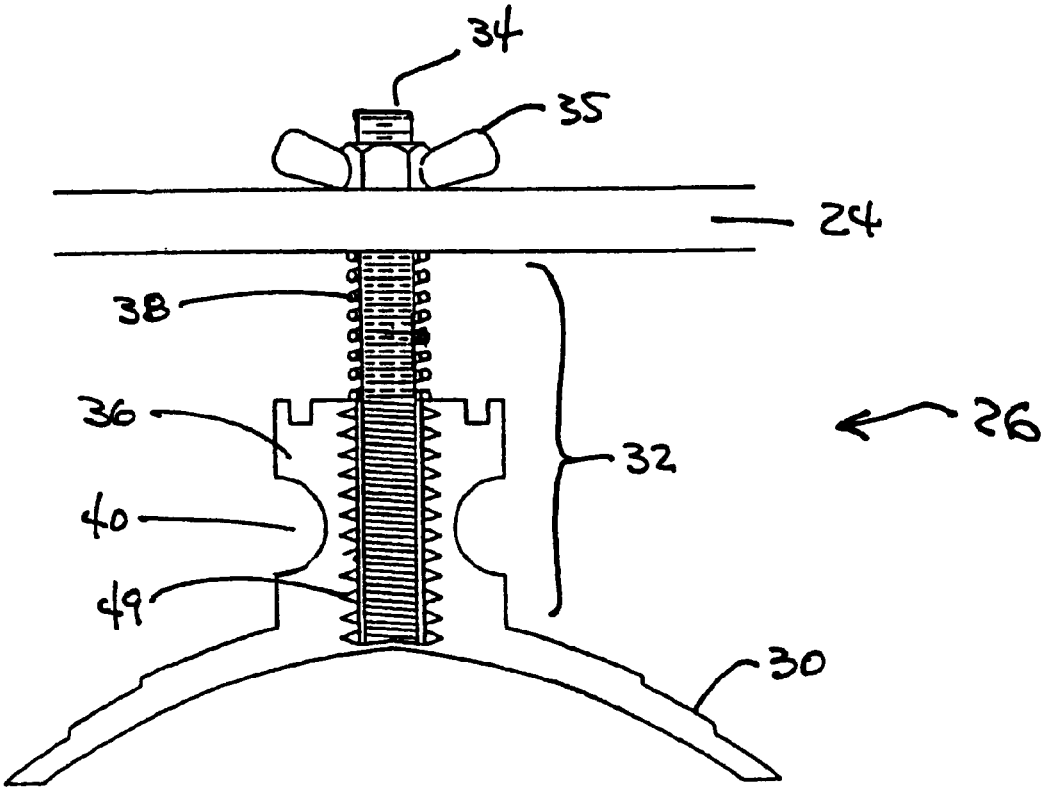
Figure 5A:
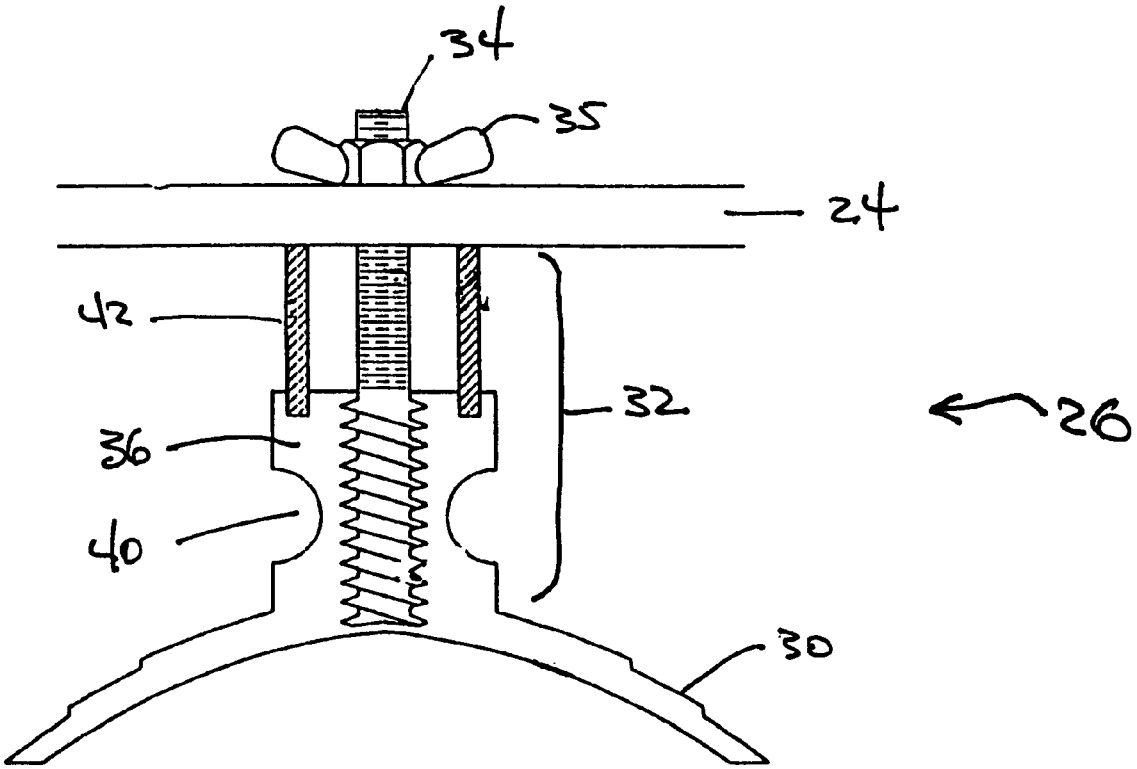
FIG. 5 is a cross-sectional view of another shock absorbing connector.
Figure 5B:
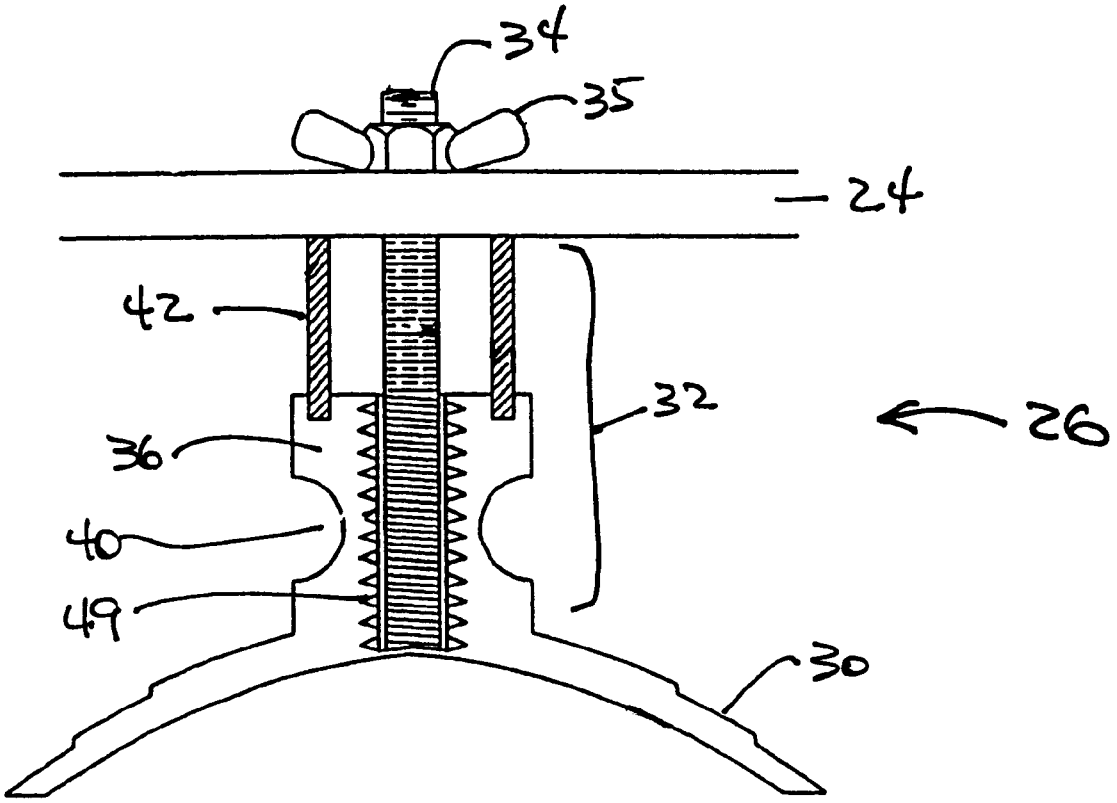

In a preferred embodiment of the storm cover 20, the shock absorbing connector 26 comprises a suction cup 28 as seen in FIGS. 1, 3, and 7–8. As shown in FIG. 2, the suction cup 28 preferably has a tab which can be pulled up to break the vacuum and release the suction cup 28 from the glass 22, allowing easy removal of the storm cover 20. The shock absorbing connector 26, of which preferred embodiments are best shown in FIGS. 4 and 5, includes a suction cup 28 for connecting to the glass 22, a shock absorbing stem 36 positioned on the suction cup 28 for helping absorb impact, and a fastener 34 positioned on the shock absorbing stem 36 for fastening the connector to the protective storm panel 24. The relatively flexible suction cup 28 has a substantially concave inner surface including a circular peripheral lip and a substantially convex outer surface.

In the connector 26 as illustrated in FIGS. 4–8, the shock absorbing stem 36 is positioned substantially centered on the convex outer surface of suction cup 28 and extending therefrom to form a distal end. The fastener 34 connects the protective storm panel 24 to the distal end of the shock absorbing stem 36. The fastener 34 preferably includes a mechanical fastener as known in the art, such as for example the threaded bolt and wing-nut 35 fastener shown in FIGS. 4 and 5.

Figure 6A:
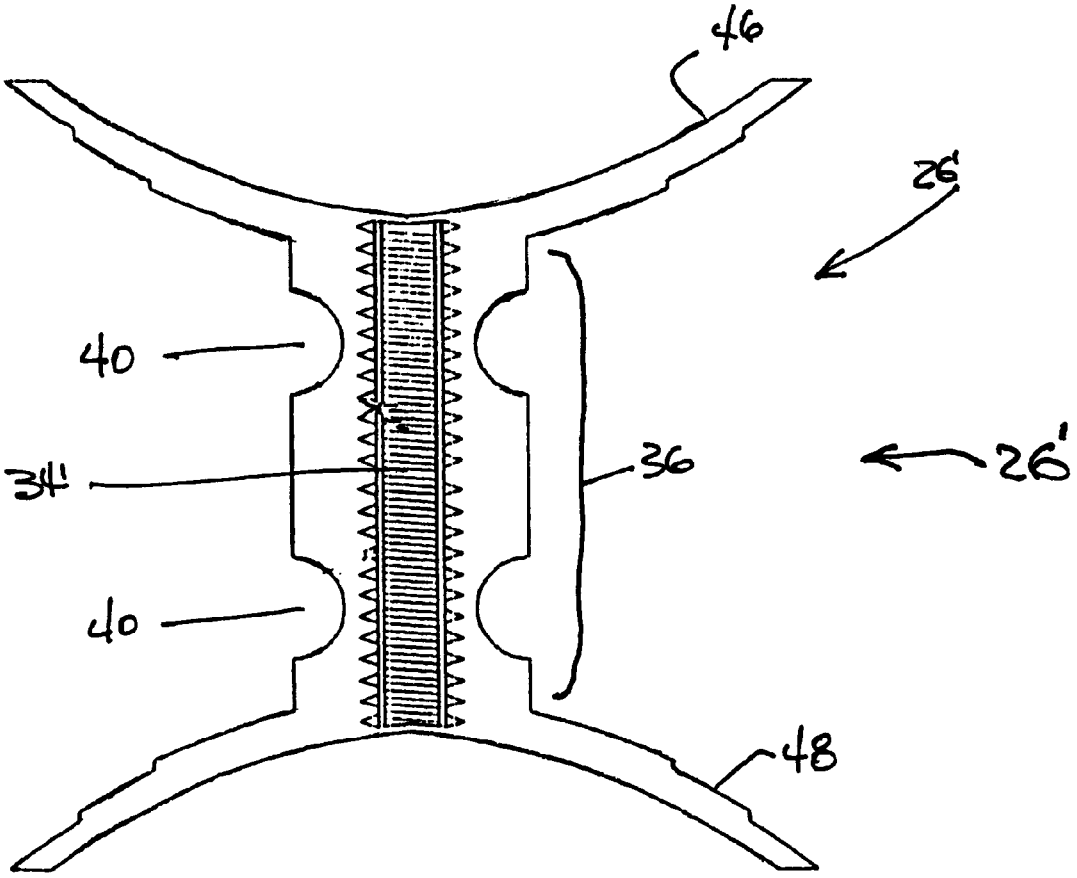
FIG. 6 is a cross-sectional view of a shock absorbing connector having a double-ended suction cup.
Figure 6B:
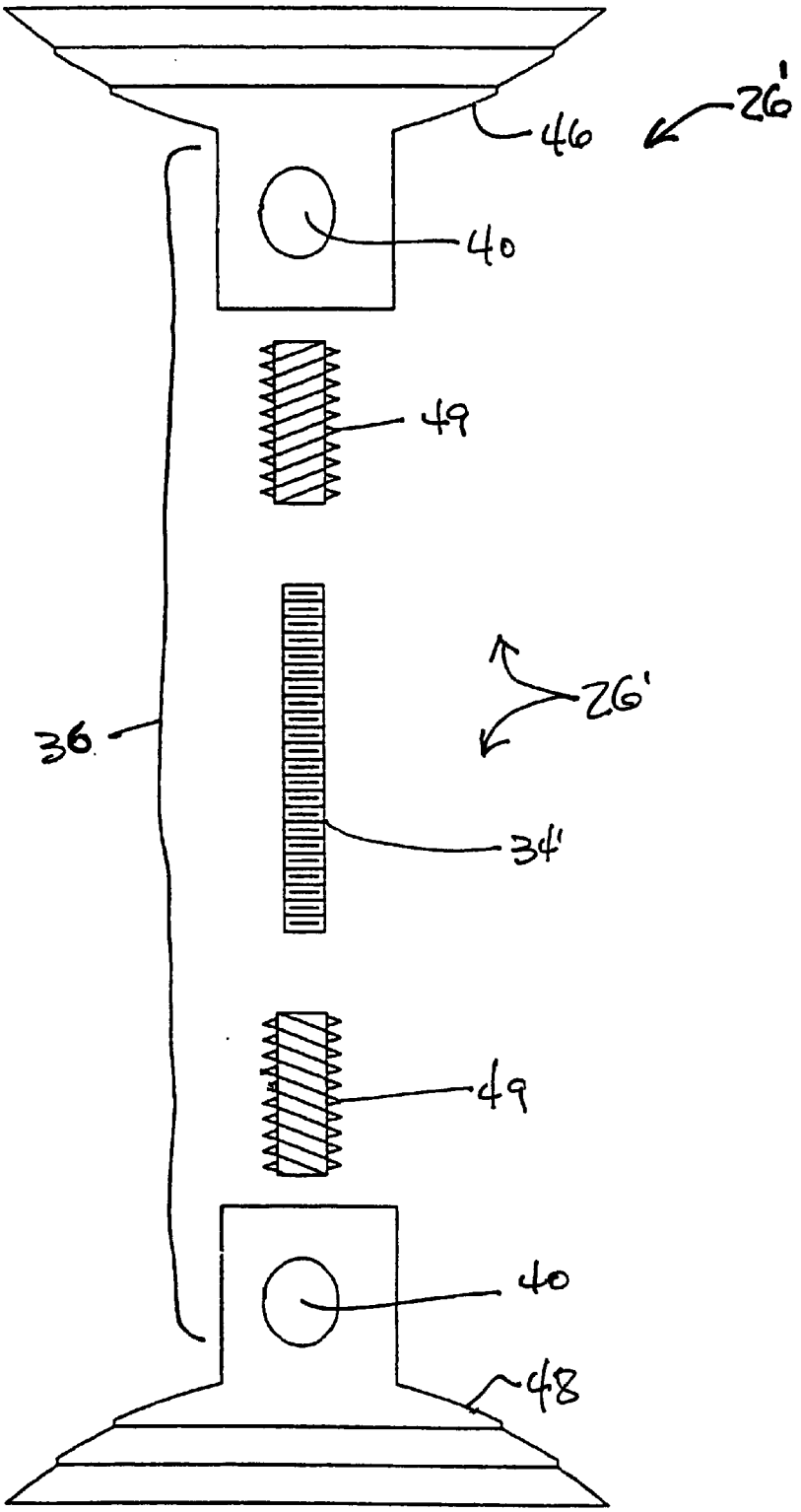

Shock absorption may be variously provided through the connector 26. For example, the shock absorbing stem 36 may preferably include a spring 38, as shown in FIG. 4. The shock absorbing stem 36 of the connector 26 may also include a shock port 40 for enhancing the resilience of the stem to thereby provide increased shock absorption, as best seen in FIGS. 4–6. In another embodiment, seen in FIG. 5, the connector 26 may include a shock absorbing stem 36 having a resilient bushing 42 positioned thereon for enhancing shock absorption capacity of the stem.

Figure 7:
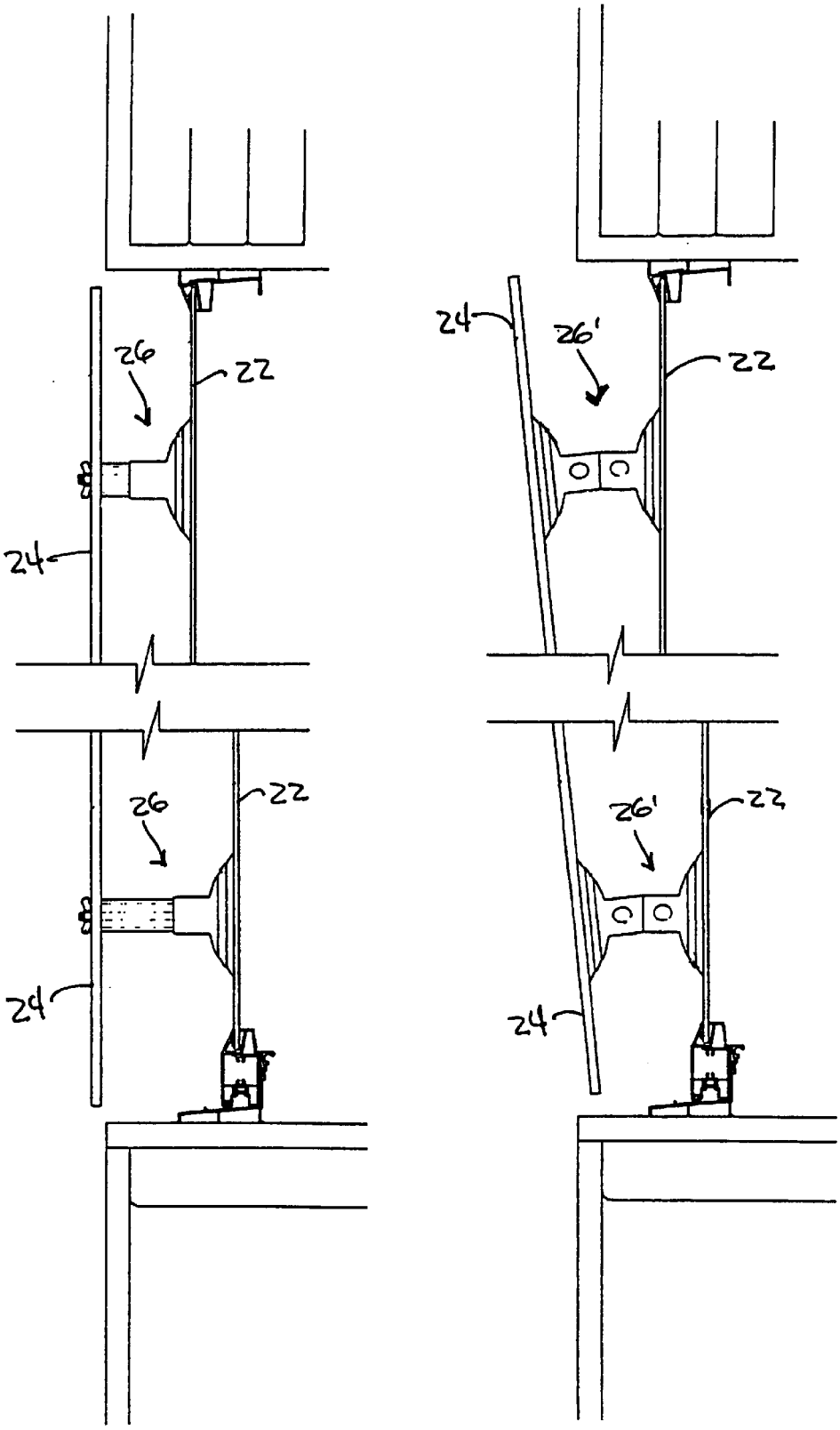
FIG. 7 is a side elevation of the storm cover including various shock absorbing connectors.

In yet another preferred embodiment, the connector may be configured as a double-ended suction cup connector 26', as seen in FIG. 6. The connector 26' has first 46 and second 48 suction cup members positioned spaced apart at opposite ends of a shock absorbing stem 36 positioned therebetween. As shown in FIGS. 7 and 8, the first suction cup 46 serves for connecting to the protective panel 24, and the second suction cup 48 for connecting to the glass 22. The double-ended suction cup connector 26' serves to thereby advantageously hold the storm cover 20 in position without the need for tools or fasteners. In addition, the double-ended connector 26' allows nearly anyone, even those having limited mechanical ability or physical strength to quickly position the storm cover over a door or window.

As shown in FIGS. 4 and 5, the connector 26 has a shock absorbing stem 36 extending therefrom. The stem 36 preferably includes an inner cavity having an opening for receiving a fastener 34 therein for securing the connector 26 to the protective panel 24. The fastener 34 is preferably a threaded fastener as known in the art, for example a screw or bolt, and the inner cavity preferably includes a threaded insert 49 for removably engaging with the fastener 34.

Those skilled in the art will readily understand that the resiliently rigid protective storm panel 24 preferably comprises a relatively easy to cut, and resiliently rigid material such as wood or plastic. A protective storm panel 24 made of wood is preferably made of a laminated wood product such as exterior grade plywood, which may be sealed with a wood protectant to help avoid delamination due to water penetration. An advantageous aspect of the invention includes the shock absorption capacity provided by the resiliency of the protective storm panel 24 itself. The present invention advantageously enhances shock absorption by the protective storm panel 24 by connecting a sufficient plurality of connectors 26 for distributing the force of an impact at multiple points along the glass 22 such that the glass is substantially protected from breakage.

Figure 9:
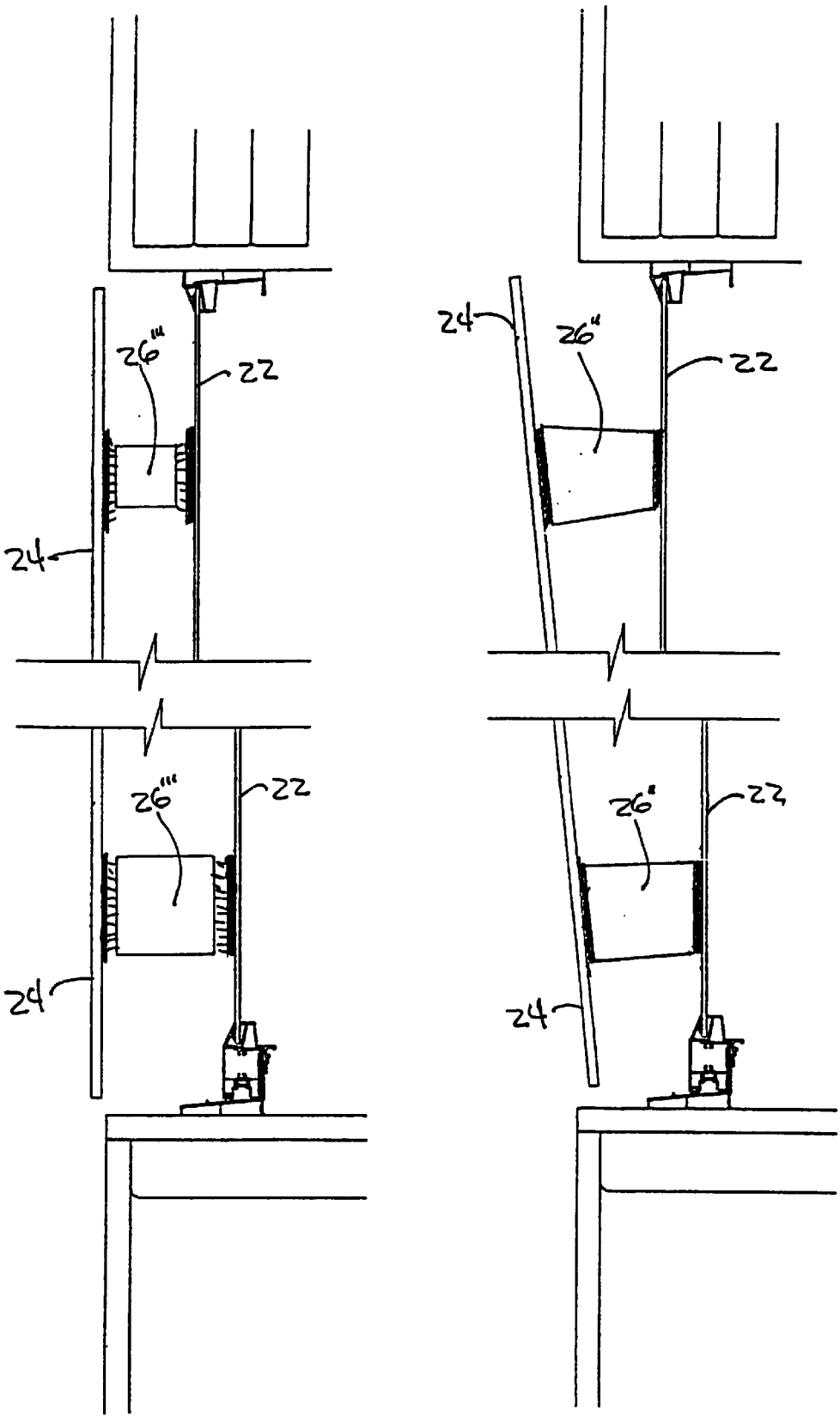
FIG. 9 is a side elevation of the storm cover with other embodiments of the connector.

In another preferred embodiment, the connector 26" and 26"' may include a substantially shock absorbing stem 36" and 36"'. For example, connector 26" and 26"' as shown in FIG. 9, include shock absorbing stems 36" and 36"' which comprise a substantially resilient material such as rubber or a flexible silicon plastic for absorbing shock. As shown in FIG. 9, in this embodiment the connector 26" includes an adhesive fastener 52 for fastening the connector to the glass 22. The adhesive fastener 52 may encompass various forms, as those skilled in the art will readily recognize. For example, the adhesive fastener 52 may include a double-sided adhesive tape which may be applied to both the glass 22 and the connector 26" to thereby fasten the connector to the glass. Similarly, such an adhesive fastener 52 would be applied not only between the connector 26" and the glass 22, but also between the connector and the protective storm panel 24 to thereby connect the protective storm panel to the glass.

Yet another embodiment of the connector 26"' is also shown in FIG. 9 to include a fastener comprising hook and loop material 54, as known in the art. Hook and loop material 54, preferably known as Velcro®, may be applied to the glass 22 and to the protective storm panel 24 and left in place thereon for use during storm emergencies. The complementary portion of the hook and loop material is applied to the shock absorbing connector 26"' for thereby connecting the connector between the glass 22 and the protective storm panel 24, as seen in FIG. 9. After protective storm panels 24 are cut to an appropriate size, this preferred embodiment of the storm cover 20 requires no other expertise, or tools for easily positioning the storm cover 20 on a door or window.

Another aspect of the present invention includes a method of protecting exterior glass on a building from impact damage during a storm. As shown in FIGS. 1 and 8, the method includes the step of connecting a resiliently rigid protective storm panel 24 directly to an exterior surface of the glass 22. Preferably the storm panel 24 is connected spaced apart from and substantially covering the glass 22. The exterior glass 22 is preferably a glass window or a glass door. Additionally, the protective storm panel may be cut to a sufficient size for extending to overlap a frame surrounding a window or door over which the protective storm panel 24 is positioned, as shown in FIG. 7.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A protective cover for a door or window having glass, said protective cover comprising:

a substantially resiliently rigid panel positioned over the glass; and at least one shock absorbing connector connecting the panel to the glass, to thereby substantially protect the glass, said shock absorbing connector comprising a suction cup having a shock absorbing stem positioned between said protective panel and said glass.

2. The protective cover of claim 1, wherein the glass comprises an exterior door or window in a building.

3. The protective cover of claim 1, wherein the door or window comprises a frame having the door or window positioned therein, and the panel extends so as to overlap said frame when connected to the glass.

4. A method of protecting a glass door or window from impact damage, comprising connecting a resiliently rigid protective panel to a surface of the glass door or window in spaced apart relation with the glass by at least one shock absorbing connector comprising a suction cup having a shock absorbing stem positioned between said protective panel and said glass to thereby substantially absorb an impact from a flying object.

5. The method of claim 4 wherein the exterior glass is a glass window or a glass door.

6. The method of claim 4 wherein the exterior glass is part of a building.

7. The protective cover of claim 1, wherein the suction cup further comprises a shock absorbing stem having a shock port.

8. The protective cover of claim 1, wherein said shock absorbing connector comprises a biasing member.

9. The protective cover of claim 8, wherein said biasing member is selected from a spring and a resilient bushing.

10. The protective cover of claim 1, wherein said shock absorbing connector comprises a fastener fastened to said panel.

11. The protective cover of claim 1, wherein said shock absorbing connector is removably connected to said panel.

12. The protective cover of claim 1, wherein said shock absorbing connector connects the panel to the glass in spaced apart relation.

13. The protective cover of claim 1, wherein said shock absorbing connector comprises a suction cup having a stem with a threaded fastener extending therefrom, the fastener fastening the panel to the shock absorbing connector.

14. The protective cover of claim 1, wherein said shock absorbing connector comprises a suction cup having a stem, a fastener extending from the stem for connecting with the panel, and a spring positioned adjacent the fastener and extending between the suction cup and the panel.

15. The protective cover of claim 1, wherein said shock absorbing connector includes a mechanical fastener fastened to said panel.

16. The protective cover of claim 1, wherein said panel comprises wood.

17. The protective cover of claim 1, wherein said panel comprises a synthetic material.

18. The protective cover of claim 1, wherein said panel comprises a substantially transparent synthetic material.

19. A protective cover for a door or window having glass, said protective cover comprising:

a substantially resiliently rigid panel positioned over the glass; and at least one suction cup connecting the panel to the glass and having a shock absorbing member positioned between said panel and said glass, to thereby substantially protect the glass.

* * * * *